US009359741B2

(12) United States Patent
Li et al.

(10) Patent No.: US 9,359,741 B2
(45) Date of Patent: Jun. 7, 2016

(54) WIND TURBINE GENERATOR FOUNDATION WITH PRESSURE-DISPERSIVE HIGH STRENGTH PRE-STRESSED ANCHORS

(71) Applicant: POWERCHINA HUADONG ENGINEERING CORPORATION LIMITED, Hangzhou, Zhejiang Province (CN)

(72) Inventors: Wei Li, Hangzhou (CN); Xingjian Sun, Hangzhou (CN); Yong Zhou, Hangzhou (CN); Yanhui Xia, Hangzhou (CN); Fabo Chen, Hangzhou (CN); Gen Xiong, Hangzhou (CN); Jiang Xu, Hangzhou (CN)

(73) Assignee: POWERCHINA HUADONG ENGINEERING CORPORATION LIMITED, Hangzhou (CN)

( * ) Notice: Subject to any disclaimer, the term of this patent is extended or adjusted under 35 U.S.C. 154(b) by 0 days.

(21) Appl. No.: 14/641,328

(22) Filed: Mar. 7, 2015

(65) Prior Publication Data

US 2015/0376858 A1 Dec. 31, 2015

(30) Foreign Application Priority Data

Jun. 25, 2014 (CN) ..... 2014 1 0290326

(51) Int. Cl.

| | |
|---|---|
| ***E02D 27/12*** | (2006.01) |
| ***E02D 27/42*** | (2006.01) |
| ***E02D 27/50*** | (2006.01) |
| ***E02D 5/30*** | (2006.01) |

(52) U.S. Cl.

CPC ..... *E02D 27/425* (2013.01); *E02D 5/30* (2013.01); *E02D 27/12* (2013.01); *E02D 27/50* (2013.01)

(58) Field of Classification Search

CPC ..... E02D 27/50; E02D 27/425; E02D 27/12
USPC ..... 405/230, 255, 208, 225, 231–233, 239, 405/244, 249, 256–257; 52/169.9, 295, 296
See application file for complete search history.

(56) References Cited

U.S. PATENT DOCUMENTS

| | | | | |
|---|---|---|---|---|
| 6,665,990 | B1 * | 12/2003 | Cody | E02D 27/42 405/244 |
| 2004/0131428 | A1 * | 7/2004 | Henderson | E02D 27/42 405/233 |
| 2007/0269273 | A1 * | 11/2007 | Henderson | E04H 12/085 405/239 |
| 2012/0070233 | A1 * | 3/2012 | Wang | E02D 27/42 405/232 |

FOREIGN PATENT DOCUMENTS

| | | | |
|---|---|---|---|
| JP | 62-21930 | * | 1/1987 |
| JP | 2-91315 | * | 3/1990 |

* cited by examiner

*Primary Examiner* — Sunil Singh
(74) *Attorney, Agent, or Firm* — PROI Intellectual Property US

(57) ABSTRACT

Disclosed is a wind turbine generator foundation with pressure-dispersive pre-stressed anchor rods or anchor ropes. The foundation comprises a pile cap, a plurality of foundation piles arranged circumferentially at the bottom of the pile cap at uniform spacing, and a wind turbine generator tower connected to an upper part of the pile cap.

3 Claims, 3 Drawing Sheets

WIND TURBINE GENERATOR FOUNDATION WITH PRESSURE-DISPERSIVE HIGH STRENGTH PRE-STRESSED ANCHORS

CROSS REFERENCE TO RELATED APPLICATION

The present application claims priority to Chinese Patent Application CN201410290326.2 filed on Jun. 25, 2014.

TECHNICAL FIELD

The present invention relates to a pile cap type wind turbine generator foundation, especially a wind turbine generator foundation with pressure-dispersive high strength pre-stressed anchor rods or anchor ropes. The wind turbine generator foundation of the present invention is applicable to on-shore as well as off-shore wind power industry.

BACKGROUND

The main part of the pile cap type wind turbine generator foundation is usually composed of a foundation pile (such as steel pipe pile or pre-stressed concrete pile) and a concrete pile cap. According to the relative relation between the pile cap and the seabed surface, it can be classified into a low pile cap foundation and a high-rise pile cap foundation. The former can be applied to the on-shore or intertidal-zone wind turbine generator foundation, while the latter can be used for off-shore wind turbine generator foundations.

For the pile cap type wind turbine generator foundation, the key to its design is the connection between the concrete pile cap and the foundation pile. Especially, along with increase in unit capacity of the wind turbine generator and continuous upgrading of the wind turbine generator load magnitude, the basic design of the pile cap type wind turbine generator foundation, especially the design of the connection part of the pile cap and the foundation pile, becomes more and more significant.

Conventionally, the foundation pile is embedded into a concrete pile cap in combination with reinforcement measures such as the reinforcing cage. As a result, the workload in constructing the pile cap are considerable (the embedded depth is required in the specification).

SUMMARY

With a view to seeking a solution to the above-mentioned technical problems, the present invention provides a wind turbine generator foundation with pressure-dispersive high strength pre-stressed anchor rods or anchor ropes featured by simple structure, convenient construction and low costs so as to improve the connection performance of the foundation piles and the pile cap of the pile cap type wind turbine generator foundation and reduce the quantities of the pile cap work.

The technical scheme employed in the present invention is as follows:

A wind turbine generator foundation with pressure-dispersive pre-stressed anchor rods or anchor ropes, the foundation comprising a pile cap, a plurality of foundation piles arranged circumferentially at the bottom of the pile cap at uniform spacing, and a wind turbine generator tower connected to an upper part of the pile cap;

wherein the interior of each one of the foundation pile is divided into the an upper part and a lower part by a blanking plate, wherein a grouting section is arranged above the blanking plate, a plurality of anchor plates, anchor heads, or flanges are placed in the grouting section, and a plurality of groups of pre-stressed anchor rods or anchor ropes are placed dispersedly in the grouting section along the longitudinal direction of the foundation pile;

wherein each group of said pre-stressed anchor rods or anchor ropes corresponds to an annular anchor plate or an anchor head, the lower end of the anchor rod or anchor rope is fixedly connected to the foundation pile and the grout in the grouting section through the anchor plate, the anchor head, or the flange; the anchor plate, the anchor head, and the flange are located at different depths of the grouting body in the pile; and the upper end of the anchor rod or anchor rope is anchored to the top of the pile cap; the pre-stressed anchor rods or anchor ropes are enveloped with plastic sleeves to make the anchor rod or anchor rope unable to adhere to the grouting body, and the pre-stressing can be transferred to the anchor plate (or anchor head, or flange) when the pre-stressing is applied; the combined arrangement of the anchor rods or anchor ropes and anchor plates (or anchor heads, or flanges) at different depths can effectively disperse the applied force borne by the grouting body.

The pre-stressed anchor rods or anchor ropes are coated with anti-corrosion grease and are enveloped with plastic sleeves, such as polyethylene sleeves.

The foundation piles are of steel pipe piles or pre-stressed concrete piles.

One or more shear connectors may be arranged on an inner wall of the foundation piles to reinforce the connection between the foundation piles and the grouting body.

A plurality of foundation piles (such as 6, 8, or 10 piles) are arranged at the bottom of the pile cap.

Beneficial effects of the present invention include the following: simple structure, convenient construction, and low costs. A plurality of groups of pre-stressed anchor rods or anchor ropes are arranged in sections in the foundation piles to connect the foundation piles and the pile cap and accordingly reinforce the connection and reduce the workload in constructing the pile cap.

DETAILED DESCRIPTION

Example 1

Figure 1:
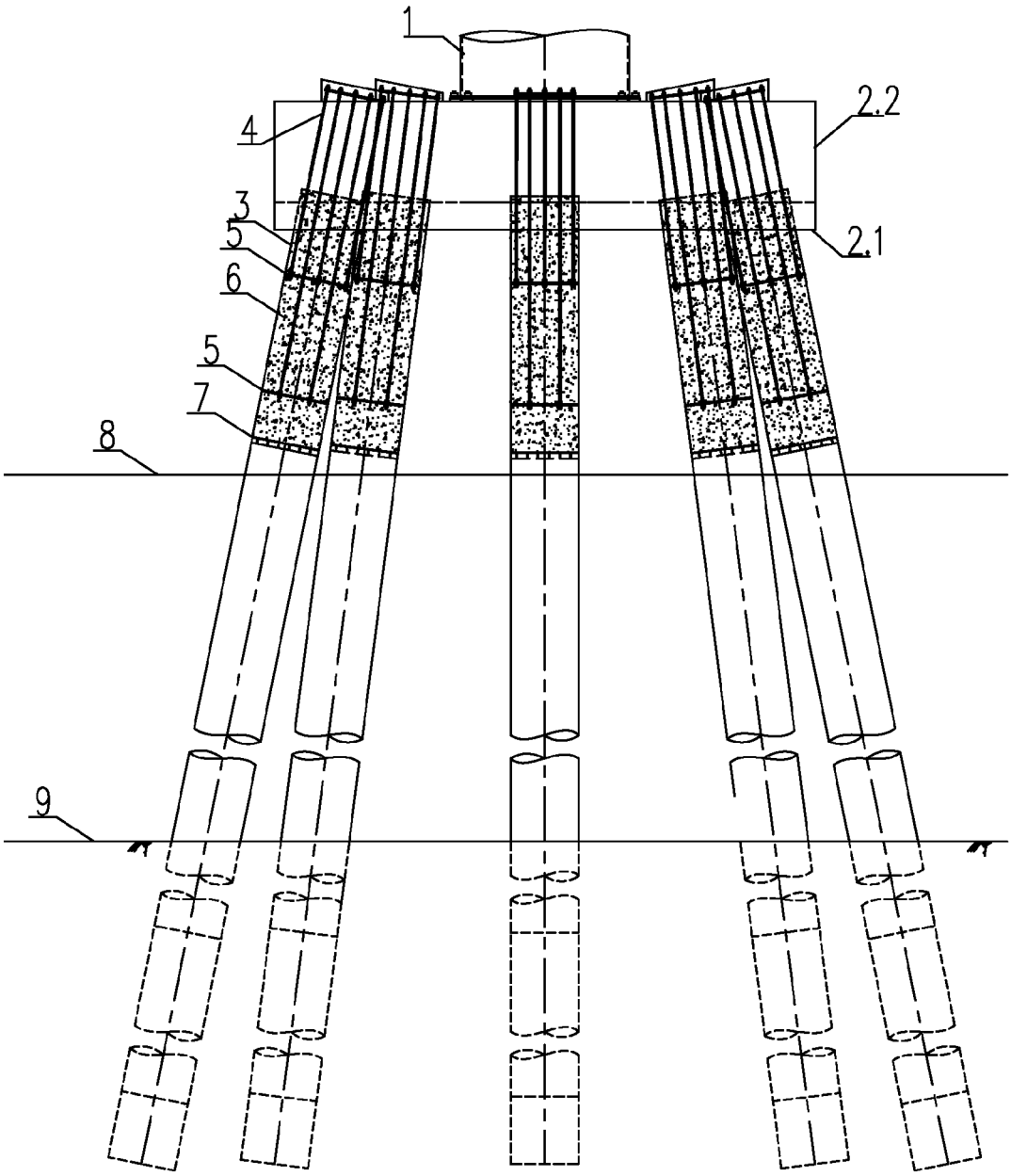
FIG. 1 shows the structure sketch of a high-rise pile cap foundation in Example 1.
Figure 2:
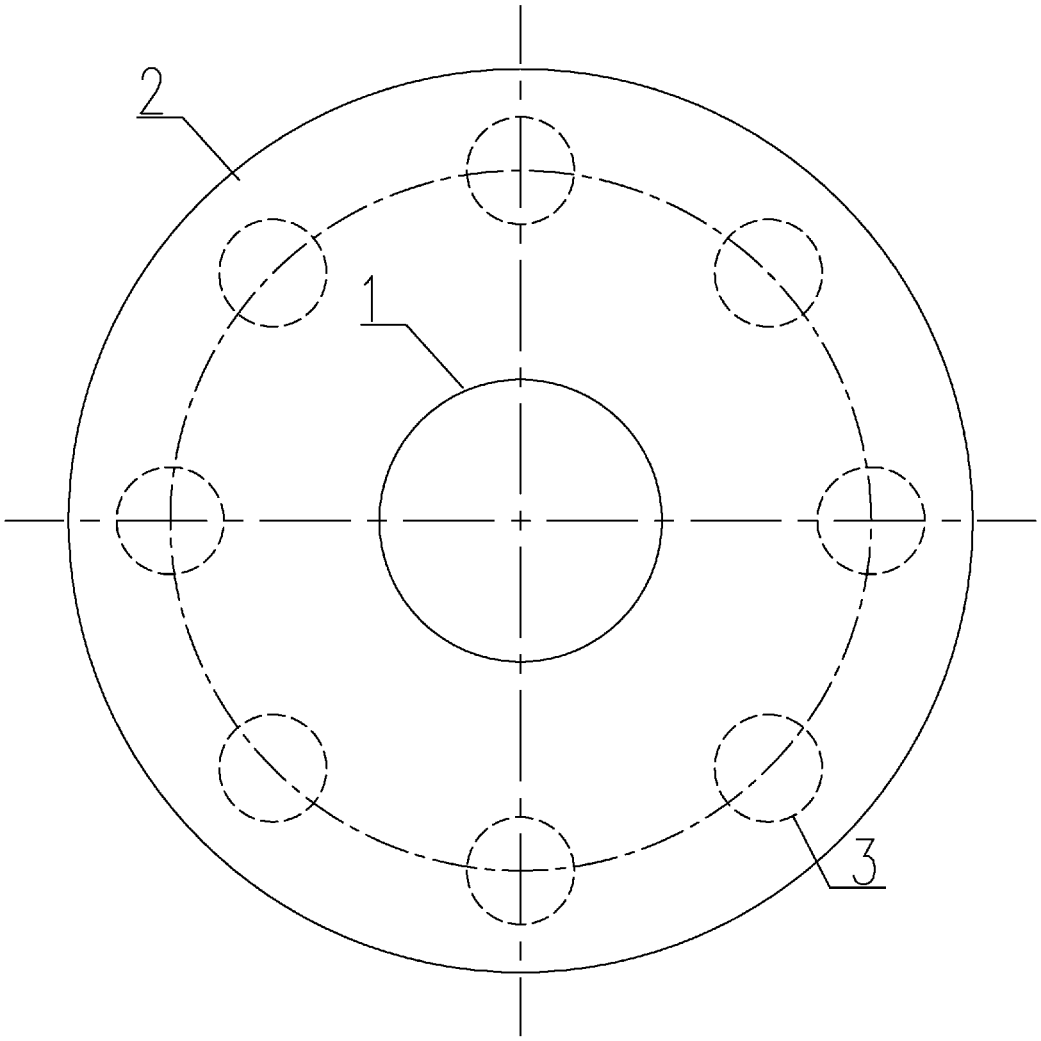
FIG. 2 shows a floor plan of FIG. 1.

As shown in FIG. 1 and FIG. 2, this example relates to a high-rise pile cap foundation. It comprises a pile cap (2) and a foundation pile (3) (normally made of steel). The pile cap (2) overtops the seabed surface (9), and the relative relation between the pile cap (2) and the sea level (8) is determined by design. The pile cap (2) comprises a first-stage concrete (2.1) for bottom sealing and a second-stage concrete (2.2) for main structures. The upper part of the pile cap 2 is connected to a wind turbine generator tower (1). A plurality of foundation piles (3) (8 piles in this example) are arranged circumferentially at the bottom of the pile cap (2) at uniform spacing. A blanking plate (7) is arranged inside the foundation pile (3), and the blanking plate (7) divides the foundation pile (3) into two parts, an upper part and a lower part. The part above the blanking plate is the grouting section, two anchor plates (or anchor heads, flanges) (5) (the specific number depends upon design needs) are placed in the grouting section at different heights. Two groups of pre-stressed anchor rods or anchor ropes (4) are placed dispersedly in the grouting section, Each group of the pre-stressed anchor rods or anchor ropes corresponds to an annular anchor plate (or an anchor head, or a flange) (5). The lower end of the anchor rod or anchor rope is fixedly connected to the foundation pile (3) and the grout (6) in the grouting section through the anchor plate (or the anchor head, or the flange) (5). The upper end of the anchor rod or anchor rope or the flange is anchored to the top of the pile cap (2). The lower end of the anchors is fixedly connected with the foundation pile (3) through the corresponding anchor plate (or anchor head) (5) and the grout (6) in the grouting section. The upper end of the anchors is anchored to the top of pile cap (2).

The reinforcement is conducted in the pile cap (2) and the grouting section of the foundation pile (3) in accordance with the requirements of the relevant codes and specifications. In this Example, the pre-stressed anchor rods or anchor ropes (4) are coated with ant-corrosion grease and enveloped with plastic sleeves (such as polyethylene sleeves).

In the construction process, firstly the foundation piles (3) are sunk, then the pre-stressed anchor rods or anchor ropes (4) and anchor plates (or anchor heads) (5) are arranged according to the design; afterwards the grout is injected into the founding pile (3) and the related construction of reinforcing cage, the first-stage concrete for bottom sealing (2.1) and the second-stage concrete (2.2) for main structures are carried out for the pile cap (2), after the strength of the pile cap (2) is up to the design requirements, pre-stressed tensioning, locking and anchoring will be conducted for pre-arranged pre-stressed anchor rods or anchor ropes (4), and the anchor head part shall be well protected.

Example 2

Figure 3:
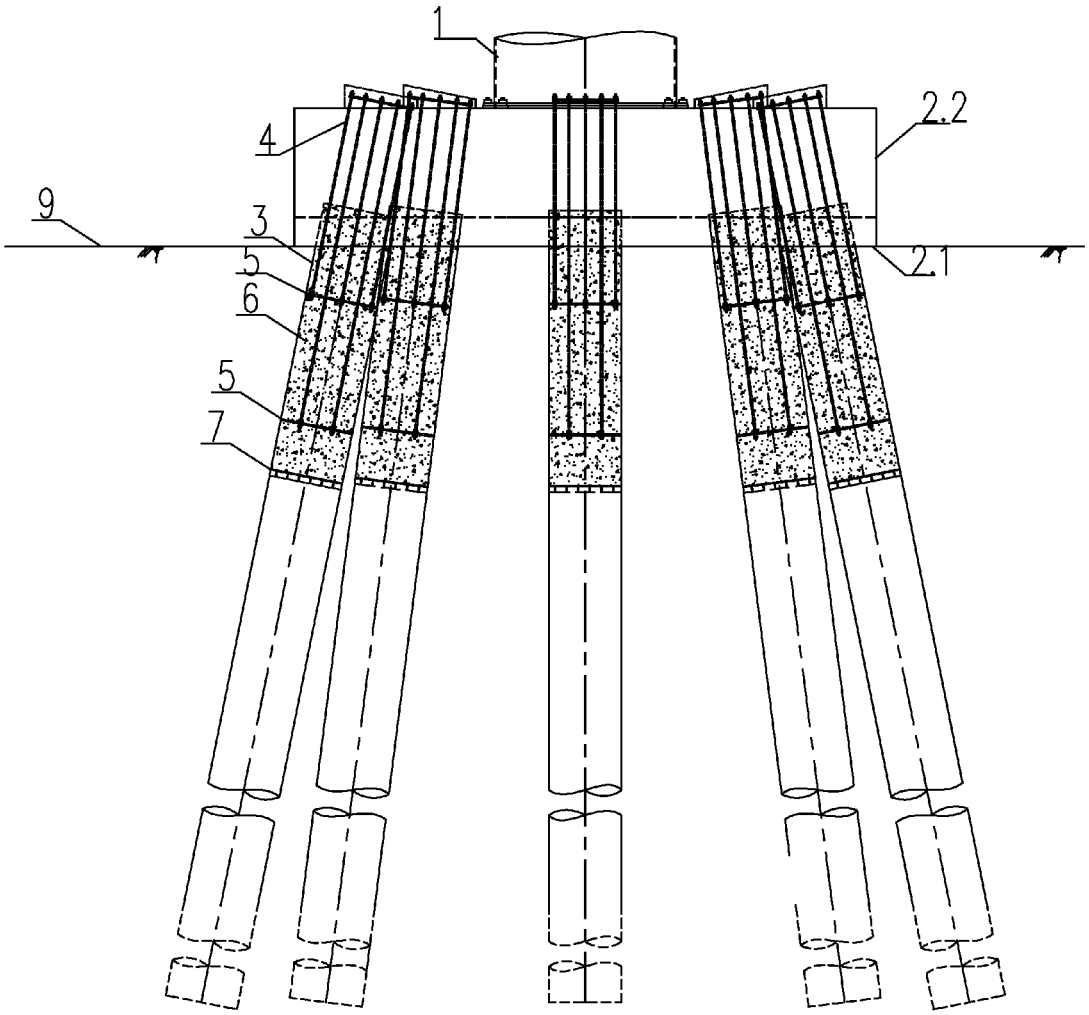
FIG. 3 shows a structure sketch of a low pile cap foundations in Example 2.

As shown in FIG. 3, the example relates to a low pile cap foundation, applicable to on-shore and intertidal-zone wind farms. The structure is basically the same as that of Example 1, whereas the difference is that the pile cap (2) is a low pile cap; namely, the pile cap is located near the seabed surface (9) (intertidal zone) or ground surface (on-shore); the steel pipe pile or pre-stressed concrete pile is usually used for the foundation pile (3).

The invention claimed is:

1. A wind turbine generator foundation with pressure-dispersive pre-stressed anchor rods or anchor ropes, the foundation comprising a pile cap, a plurality of foundation piles arranged circumferentially at the bottom of the pile cap at uniform spacing, and a wind turbine generator tower connected to an upper part of the pile cap;

wherein the interior of each one of the foundation piles is divided into an upper part and a lower part by a blanking plate; wherein a grouting section is arranged above the blanking plate; a plurality of anchor plates, anchor heads, or flanges are placed in the grouting section; and a plurality of groups of said pressure-dispersive pre-stressed anchor rods or anchor ropes are placed dispersedly in the grouting section along the longitudinal direction of the foundation pile;

wherein each group of said pressure-dispersive pre-stressed anchor rods or anchor ropes corresponds to one of said plurality of annular anchor plates, anchor heads, or flanges; the lower end of each anchor rod or anchor rope in said each group of pressure-dispersive pre-stressed anchor rods or anchor ropes is fixedly connected to the foundation pile and a grout in the grouting section through the corresponding anchor plate, anchor head, or flange; said plurality of anchor plates, anchor heads, and flanges are located at different depths of the grouting section in the pile; and the upper end of each anchor rod or anchor rope in said each group of pressure-dispersive pre-stressed anchor rods or anchor ropes is anchored to the top of the pile cap; the pressure-dispersive pre-stressed anchor rods or anchor ropes are enveloped with plastic sleeves.

2. The wind turbine generator foundation of claim 1, wherein the pressure-dispersive pre-stressed anchor rods or anchor ropes are coated with anti-corrosion grease and wherein said plastic sleeves are polyethylene sleeves.

3. The wind turbine generator foundation of claim 1, wherein the foundation piles are steel pipe piles or pre-stressed high intensity concrete piles.

* * * * *